US006616430B2

(12) United States Patent
Mori et al.

(10) Patent No.: US 6,616,430 B2
(45) Date of Patent: Sep. 9, 2003

(54) SCROLL COMPRESSORS

(75) Inventors: Tatsushi Mori, Kariya (JP); Masao Iguchi, Kariya (JP); Shinsuke Asou, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/158,041

(22) Filed: May 29, 2002

(65) Prior Publication Data

US 2002/0182094 A1 Dec. 5, 2002

(30) Foreign Application Priority Data

May 30, 2001 (JP) ..... 2001-162819

(51) Int. Cl.[7] ..... F03C 2/00

(52) U.S. Cl. ..... 418/55.3; 418/55.5; 418/57; 418/188

(58) Field of Search ..... 418/55.3, 188, 418/55.5, 57; 417/410.5

(56) References Cited

U.S. PATENT DOCUMENTS 4,753,582 A * 6/1988 Morishita et al. ..... 418/55.5
4,927,339 A * 5/1990 Riffe et al. ..... 418/55.3
5,090,876 A * 2/1992 Hashizume et al. ..... 417/410.5

FOREIGN PATENT DOCUMENTS

JP 61-190183 8/1986
JP 62-191685 8/1987
JP 63263286 A * 10/1988 ..... F04C/18/02
JP 2-125985 5/1990
JP 04066791 A * 3/1992 ..... F04C/18/02
JP 4-166686 6/1992
JP 05018203 A * 1/1993 ..... F01C/01/02
JP 05118324 A * 5/1993 ..... F16C/19/12
JP 7-229480 8/1995

OTHER PUBLICATIONS

U.S. patent application Ser. No. 10/123,602 filed, Apr. 15, 1992, Mori, et al.

* cited by examiner

*Primary Examiner*—Thomas Denion
*Assistant Examiner*—Theresa Trieu
(74) *Attorney, Agent, or Firm*—Woodcock Washburn LLP

(57) ABSTRACT

Scroll compressors (1) may include a housing (2, 3) having an inlet port (3*a*) and an outlet port (3*b*). A drive scroll (10) may be rotatably disposed within the housing and may have a rotational axis. A driven scroll (20) may be rotatably disposed within the housing and may have a rotational axis. The driven scroll rotational axis preferably is offset with respect to the drive scroll rotational axis. Further, at least one compression chamber (30) is preferably defined between the drive scroll and the driven scroll. First bearings (14, 16, 16*a*) may rotatably support one of the drive scroll and the driven scroll in a straddle manner. A second bearing (24) may rotatably support the other of the drive scroll and the driven scroll in a cantilever manner. A transmission (31, 131, 231 and 331) or other device may be provided to rotate the driven scroll in synchronism with the drive scroll.

19 Claims, 8 Drawing Sheets

SCROLL COMPRESSORS

BACKGROUND OF THE INVENTION

1. Field of the Invention

The present invention relates to scroll compressors, and in particular to scroll compressors known as "double rotational compressors," in which a drive scroll rotates in synchronism with a driven scroll about respective rotational axes that are offset with respect to each other.

2. Description of Related Art

Japanese Laid-open Patent Publication No. 7-229480 discloses a double rotational scroll compressor, in which a drive scroll and a driven scroll oppose each other and define a compression chamber therebetween. The drive and driven scrolls are disposed within a rotor of an electric motor and the drive scroll is secured to the rotor. Further, the rotor and the drive scroll are rotatably and coaxially supported within a housing, i.e., a sealed chamber that accommodates the scrolls. The driven scroll is rotatably supported by an eccentric mechanism that is mounted on a shaft and the shaft extends though the rotor. An Oldham's coupling serves to transmit the rotation of the rotor or the drive scroll to the driven scroll.

Therefore, during the operation of the compressor, refrigerant (cooling medium) is drawn into the compression chamber via a suction channel defined within the drive scroll. The refrigerant is then compressed within the compression chamber and is highly pressurized. The compressed refrigerant is thereafter discharged into the sealed chamber within the housing via a discharge channel defined within the drive scroll.

Because the highly pressurized refrigerant is discharged into the sealed chamber of the known double rotation compressor, the pressure of the discharged refrigerant is applied to the entire rear surface of the driven scroll. Therefore, the driven scroll is forcibly pressed against the drive scroll and a possibility exists that the tip ends of the scroll walls will be damaged due to the driven scroll being forcibly pressed against the drive scroll.

SUMMARY OF THE INVENTION

Therefore, it is one object of the present teachings to provide improved scroll compressors. In one aspect of the present teachings, scroll compressors are taught that include means for preventing scroll walls from being damaged.

In another aspect of the present teachings, scroll compressors are taught that have a drive scroll opposing a driven scroll. One or more compression chambers may be defined between the drive scroll and the driven scroll. A first scroll selected from the drive and driven scrolls may be rotatably supported in a straddle manner. That is, both ends of the first scroll are rotatably supported, e.g., by a housing. A second scroll selected from the other of the drive and driven scrolls may be rotatably supported in a cantilever manner and in a manner that permits the second scroll to move or slide along its axial direction. A discharge chamber may be defined on the side of the second scroll that is opposite to the compression chamber. Therefore, when refrigerant (cooling medium) is compressed within the compression chamber(s) and is discharged into the discharge chamber, the pressure of the discharged refrigerant will apply a thrust force against the second scroll and urge the second scroll towards the first scroll. Such a thrust force may depend upon the volume and/or the surface area of the discharge chamber onto which the thrust force is applied. By appropriately applying the thrust force against the pressure receiving area defined on the second scroll, the scroll walls of the respective drive and drive scrolls may be prevented from being damaged.

In another aspect of the present teachings, the drive and driven scrolls may be disposed within an enclosed chamber that defines a refrigerant suction area. An electric motor also may be disposed within the same enclosed chamber and the electric motor may rotatably drive the drive scroll. Because the drawn refrigerant disposed within the enclosed chamber has a relatively low pressure, the thickness of the walls of the enclosed chamber may be relatively thin. Therefore, the entire compressor may have a relatively lightweight construction. In addition, refrigerant that enters into the enclosed chamber may be utilized to effectively cool the electric motor, as well as bearings that may support the drive and driven scrolls. Optionally, the refrigerant may contain a lubricant (e.g., a lubrication oil) that serves to lubricate the rotational support portions of the electric motor and the bearings.

In another aspect of the present teachings, a transmission or other means for rotating the driven scroll in synchronism with the drive scroll may be provided. For example, the transmission may include a first torque transmission member disposed on the drive scroll and a second torque transmission member disposed on the driven scroll. The first torque transmission member may slidably contact the second torque transmission member, so that the rotation of the drive scroll is transmitted to the driven scroll. Therefore, the driven scroll can synchronously rotate with the drive scroll and the rotational axis of the driven scroll is preferably offset with respect to the rotational axis of the drive scroll.

Preferably, the first transmission member can rotate relative to and around the second torque transmission member. Further, the radius of rotation of the first transmission member may be equal to the distance between the rotational axes of the drive scroll and the driven scroll. Therefore, rotational torque may be smoothly transmitted.

In another aspect of the present teachings, the first transmission member may comprise one of a pin or a ring and the second transmission member may comprise the other of a pin or a ring. In that case, the pin can slidably rotate along the inner circumferential surface of the ring. In another aspect, the first transmission member and the second transmission member may comprise respective pins, and a ring may couple the respective pins. In that case, the pins can slidably rotate along the inner circumferential surface of the ring. In another aspect, the first and second torque transmission members may respectively comprise a first pin and a second pin. In that case, the first pin can slidably contact and rotate around the second pin. Further, a ring may be rotatably mounted on one of the first pin or the second pin, so that the first pin or the second pin can slidably rotate around the ring.

Additional objects, features and advantages of the present invention will be readily understood after reading the following detailed description together with the accompanying drawings and the claims.

DETAILED DESCRIPTION OF THE INVENTION

Figure 1:
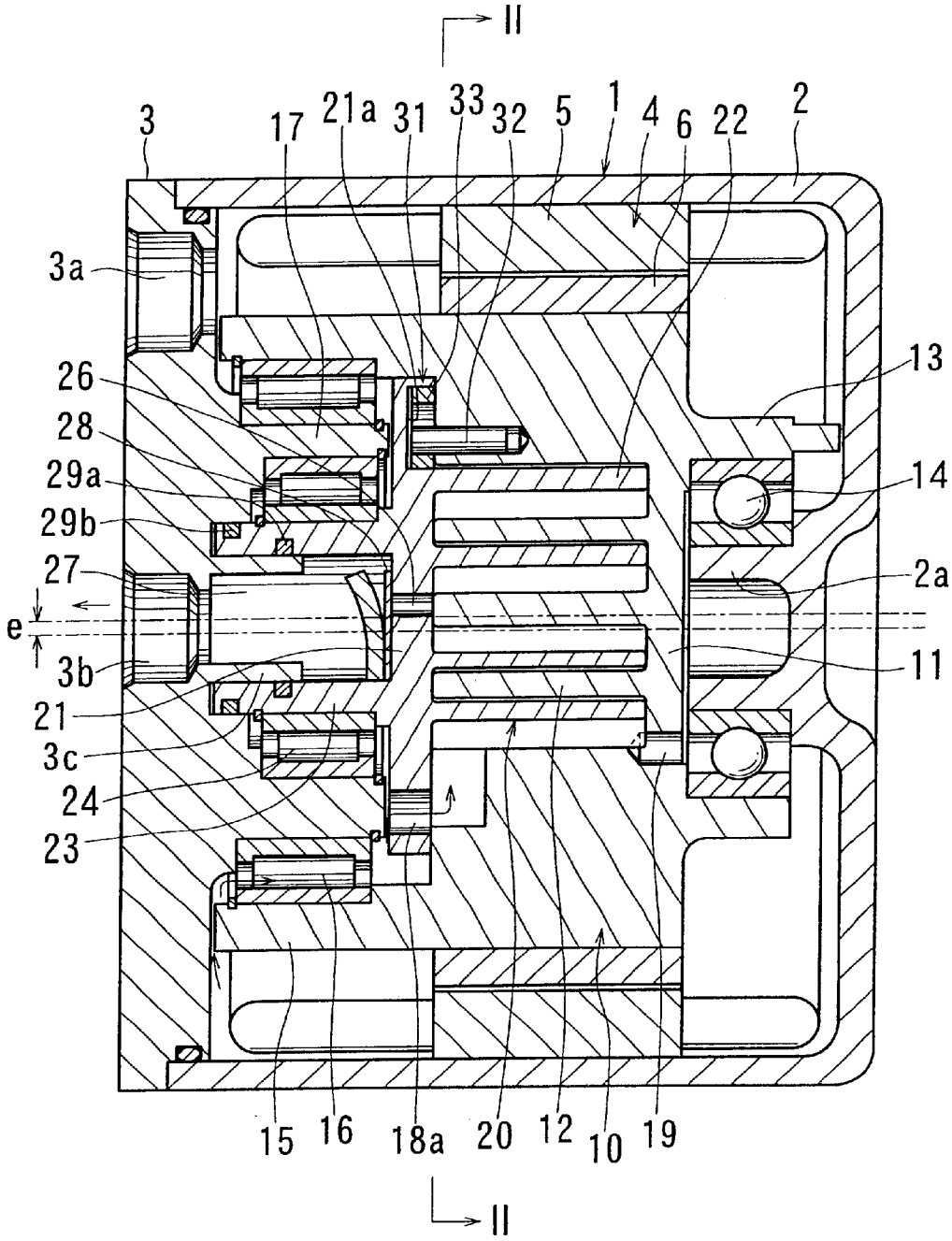
FIG. 1 is a vertical cross-sectional view of a first representative scroll compressor.

In one embodiment of the present teachings, scroll compressors may include a compressor housing having an inlet port and an outlet port. A drive scroll may be rotatably disposed within the compressor housing and may have a rotational axis. A driven scroll may be rotatably disposed within the compressor housing and may have a rotational axis. The driven scroll rotational axis is preferably offset with respect to the drive scroll rotational axis. At least one compression chamber is preferably defined between the drive scroll and the driven scroll. Optionally, first bearings may rotatably support the drive scroll in a straddle manner. A second bearing may rotatably support the driven scroll in a cantilever manner and may permit the driven scroll to move or slide along its axial direction. The first and second bearings are preferably disposed within the compressor housing.

In another embodiment of the present teachings, a transmission or other means may be provided for rotating the driven scroll in synchronism with the drive scroll. For example, the rotational axis of the drive scroll may be parallel, or substantially parallel, to the rotational axis of the driven scroll. However, the respective rotational axes may be offset with respect to each other in a direction perpendicular to the rotational axes. The transmission or rotating means may include a transmission mechanism that causes the driven scroll to revolve or orbit with respect to the drive scroll.

In another embodiment of the present teachings, the transmission mechanism may include at least two first members coupled to at least one of the drive scroll or the driven scroll and at least two second members coupled to at least one of the drive scroll or the driven scroll. The respective first members may slidably contact the respective second members. In that case, rotational torque may be transmitted from the drive scroll to the driven scroll as the drive scroll rotates.

In another embodiment, the transmission mechanism may include a first torque transmission member disposed on the drive scroll and a second torque transmission member disposed on the driven scroll. The first torque transmission member may slidably contact the second torque transmission member so that rotation of the drive scroll is transmitted to the driven scroll. Optionally, the first transmission member can rotate relative to and around the second torque transmission member. Further, the radius of rotation of the first transmission member may be equal to the distance between the rotational axes of the drive scroll and the driven scroll.

In another embodiment, the first transmission member may include a pin and the second transmission member may include a ring. For example, the pin may slidably rotate along the inner circumferential surface of the ring. In another embodiment, the first transmission member and the second transmission member each include pins and a ring may couple the respective pins. In this case, the pins may slidably rotate along the inner circumferential surface of the ring. In another embodiment, the first and second torque transmission members may respectively include a first pin and a second pin. In this case, the second pin may slidably rotate about the first pin. In another embodiment, a ring may be rotatably mounted on one of the first pin or the second pin. In this case, the first pin or the second pin may slidably rotate around the ring.

In another embodiment, the drive scroll may include first support portions, which are rotatably supported by the first bearings, and the driven scroll may include a second support portion, which is rotatably supported by the second bearing. The first support portions may be respectively disposed on opposite sides of the compression chamber(s) along the axial direction of the first support portions. Optionally, the first support portions may each have a hollow cylindrical cross-section and the first support portions may be fitted onto the first bearings. Further, the second support portion may have a hollow cylindrical cross-section and the second support portion may be fitted within the second bearing. Preferably, the housing may include a cylindrical portion. One of the first support portions of the drive scroll may be fitted onto the cylindrical portion via one of the first bearings. The second support portion of the driven scroll may be fitted into the cylindrical portion via the second bearing. The inner space of the second support portion may define a discharge chamber.

In another embodiment, an electric motor may rotatably drive the drive scroll. The electric motor may include a rotor secured to the drive scroll and a stator secured to an inner wall of the housing. Optionally, the stator, the rotor and the drive scroll may be concentrically disposed. For example, the rotor may be disposed within the stator and the drive scroll may be disposed within and secured to the rotor.

In addition, the housing may be formed as an enclosed chamber (e.g., substantially sealed chamber) that accommodates the drive and driven scrolls and the electric motor. Preferably, the enclosed chamber may be designed such that the refrigerant that has been drawn into the housing may flow around the electric motor and the bearings that are associated with the drive and driven scrolls. Therefore, the electric motor can be efficiently cooled by the drawn refrigerant. In addition, the bearings may be lubricated by the refrigerant. The refrigerant may have inherent lubricating properties or a lubricant (e.g., a lubricating oil) may be added to the refrigerant in order to impart lubricating properties to the refrigerant.

Various methods also are taught for compressing a refrigerant using the present scroll compressors, which are described above and below in further detail. Generally speaking, such methods may include drawing refrigerant into the compression chamber(s) and rotating the drive scroll in synchronism with the driven scroll in order to generate pressurized refrigerant. In one optional method, the driven scroll is biased toward the drive scroll by the pressure applied by the refrigerant that has been discharged into the discharge chamber. The discharge chamber preferably may be defined by or within the driven scroll and may be disposed on the side of the driven scroll opposite to the compression chamber. Therefore, the biasing force can be easily determined by appropriately designing the discharge chamber, as will be discussed further below.

In the alternative, the discharge chamber may be defined on the side of the drive scroll that is opposite to the compression chamber(s). Further, the drive scroll may be supported in a cantilever manner and may be permitted to move or slide along is axial direction. If the pressurized refrigerant is discharged into the discharge chamber defined by or within the drive scroll, the drive scroll will be biased towards the driven scroll during operation. Again, the biasing force applied by the refrigerant against the driven scroll can be adjustable determined by appropriately designing the discharge chamber, as discussed further below.

Each of the additional features and method steps disclosed above and below may be utilized separately or in conjunction with other features and method steps to provide improved scroll compressors and methods for designing and using such scroll compressors. Representative examples of the present invention, which examples utilize many of these additional features and method steps in conjunction, will now be described in detail with reference to the drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe some representative examples of the invention, which detailed description will now be given with reference to the accompanying drawings.

Figure 2:
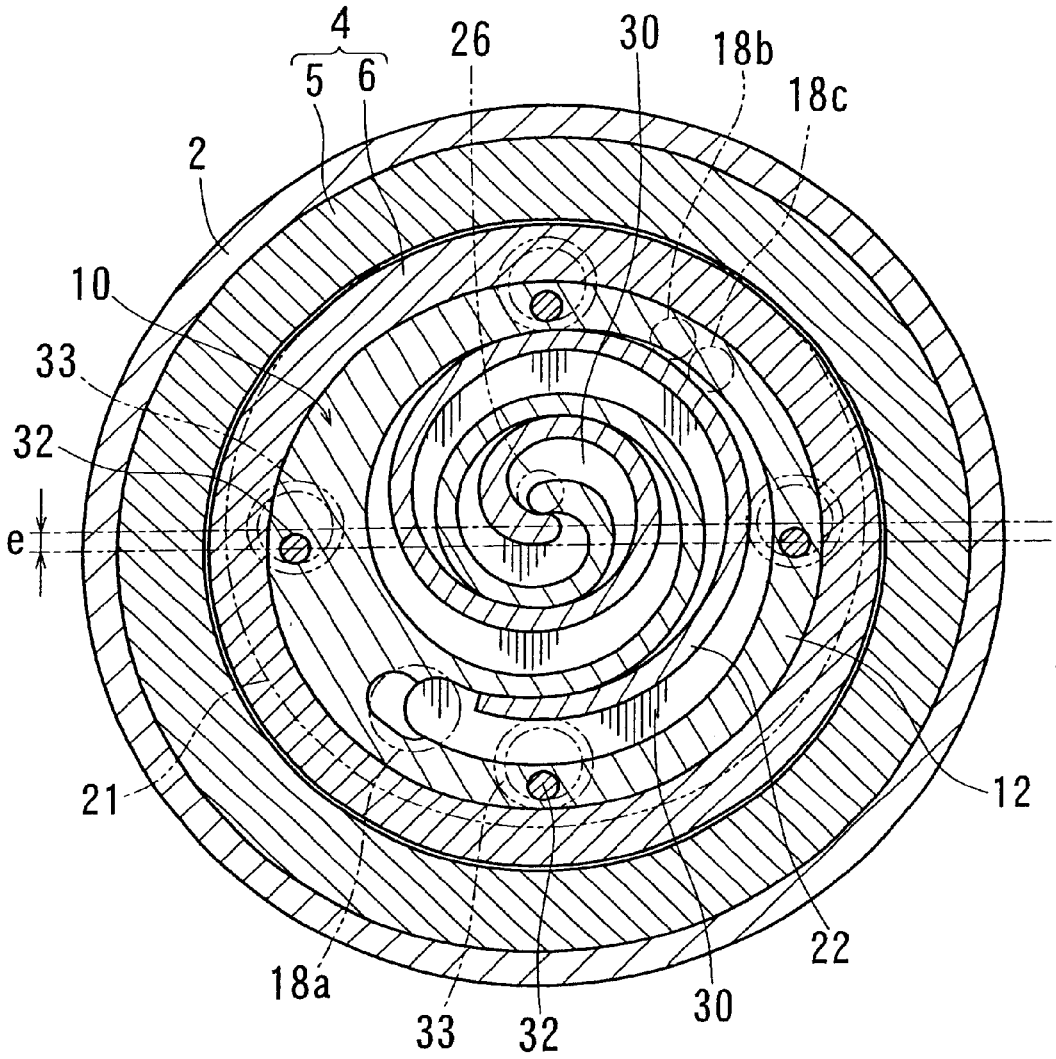
FIG. 2 is a sectional view taken along line II—II shown in FIG. 1.

A first representative embodiment will now be described with reference to FIGS. 1 to 4. As shown in FIGS. 1 and 2, a representative scroll compressor 1 may include a front cover 3 that is attached to a substantially tubular main housing 2 in order to enclose (e.g., seal) a front opening defined within the main housing 2. Thus, the compressor housing may comprise the main housing 2 and the front cover 3, although other housing arrangements are contemplated by the present teachings. Therefore, a substantially enclosed space is defined within the compressor housing. An electric motor 4 and a scroll compression mechanism, which may include a drive scroll 10 and a driven scroll 20, may be disposed within the compressor housing.

The electric motor 4 may include an annular-shaped rotor 6 positioned or disposed within an annular-shaped stator 5. The drive scroll 10 may be fixedly fitted within the rotor 6. In this case, the drive scroll 10 will rotate with the rotor 6. The driven scroll 20 may be disposed so as to oppose the drive scroll 10. The drive scroll 10 may include a scroll wall 12 that extends or projects from one side of a circular disk-like base plate 11. Similarly, the driven scroll 20 may include a scroll wall 22 that extends or projects from one side of a circular disk-like base plate 21. The drive scroll 10 and the driven scroll 20 are preferably arranged such that the scroll walls 12 and 22 engage with each other during compressor operation. For example, the scroll walls 12 and 22 may contact each other at a plurality of positions so as to define a plurality of substantially crescent-shaped compression chambers (closed chambers) 30 between the scroll walls 12 and 22, as shown in FIG. 2.

Referring to FIG. 1, a substantially cylindrical boss portion 13 may extend from the base plate 11 on the side opposite to the compression chambers 30. A protruding portion or a support portion 2*a* may be rotatably supported by the inner circumferential wall of the cylindrical boss portion 13 via a ball bearing 14. A cylindrical portion 15 may be formed at the outer periphery of the drive scroll 10 and may extend forwardly (leftward as viewed in FIG. 1) beyond the scroll wall 12 of drive scroll 10. The inner peripheral surface of the cylindrical portion 15 may be rotatably supported via a needle bearing 16 on the outer peripheral surface of a cylindrical portion 17, which extends or projects from the front cover 3. The needle bearing 16 preferably includes both outer and inner races. Thus, the drive scroll 10 is rotatably supported in a straddle manner by the main housing 2 and the front cover 3 from both rear and front sides of the compression chamber 30, respectively. Furthermore, the ball bearing 14 and the needle bearing 16 may constitute first bearings for rotatably supporting a first scroll in a straddle manner according to the present teachings.

Referring to FIG. 1, a cylindrical boss portion 23 may extend from the base plate 21 on the side opposite to the compression chambers 30. A needle bearing 24 may rotatably and axially movably support the outer peripheral surface of the cylindrical boss portion 23 against the inner peripheral surface of the cylindrical portion 17 of the front cover 3. The needle bearing 24 also preferably includes both outer and inner races and may constitute a second bearing for rotatably supporting a second scroll in a cantilever manner according to the present teachings. The rotational axis of the driven scroll 20 (i.e., the rotational axis of the cylindrical boss portion 23) may extend in parallel to the rotational axis of the drive scroll 10 (i.e., the rotational axis of the cylindrical boss portion 13), but may be offset to the rotational axis of the drive scroll 10 in a direction perpendicular to the rotational axis by a distance "e," as shown in FIGS. 1 and 2.

Thus, the driven scroll 20 is rotatably supported only by the front cover 2 in a cantilever manner from the front side of the compression chamber 30 via the needle bearing 24. Moreover, the driven scroll 20 is also axially movable in this representative embodiment.

Herein, the term "cantilever" is intended to encompass support structures that include a member that is supported at only one end. Thus, cantilever support structures differ from support structures in which a drive scroll or a driven scroll is supported at both sides in a "straddle" manner (i.e., both sides of a drive scroll or a driven scroll are supported). For example, in the first representative embodiment shown in FIG. 1, the driven scroll 20 is supported in a cantilever manner (i.e., only from the rear side or the side that is opposite to the compression chambers 30). Consequently, such a support structure may be referred to as a cantilever support structure. However, in the second representative embodiment shown in FIG. 8, the drive scroll 10 is supported in a cantilever manner (i.e., only from the rear side or the side that is opposite to the compression chambers 30) and the driven scroll 20 is supported in a straddle manner.

Figure 3:
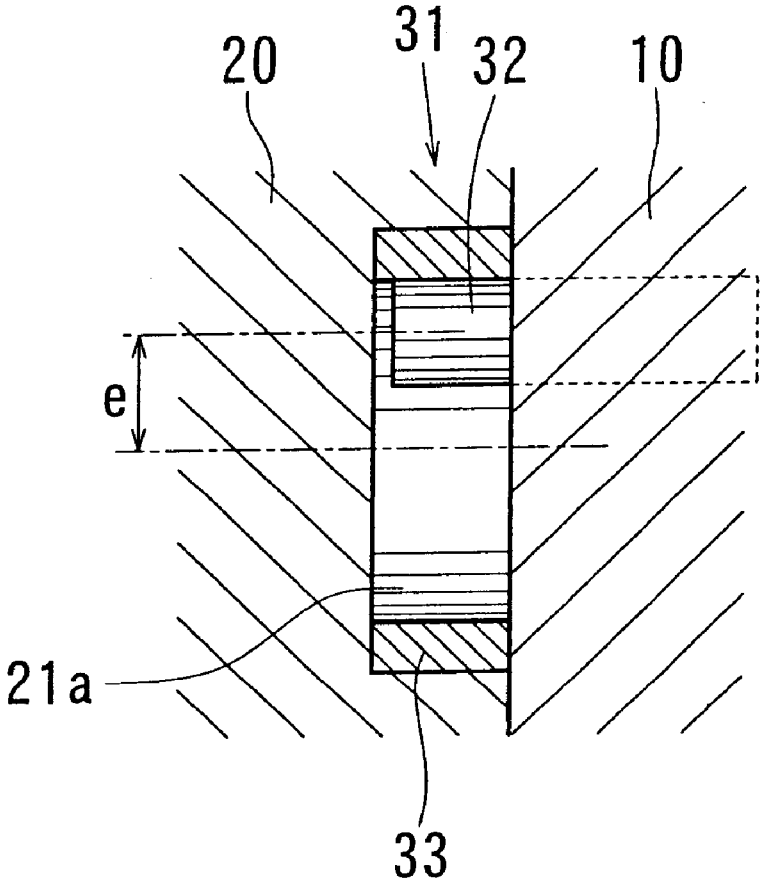
FIG. 3 is a cross-sectional view of a representative transmission mechanism.
Figure 4:
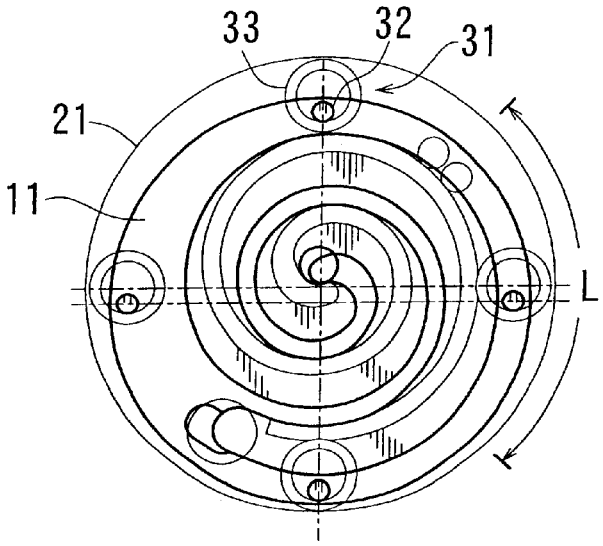
FIGS. 4(A) to 4(F) are views illustrating the compressor disposed in various angular positions during operation of the compressor.
Figure 4:
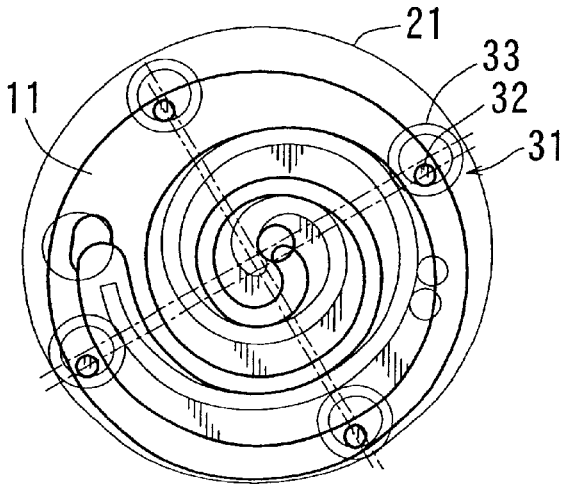
Figure 4:
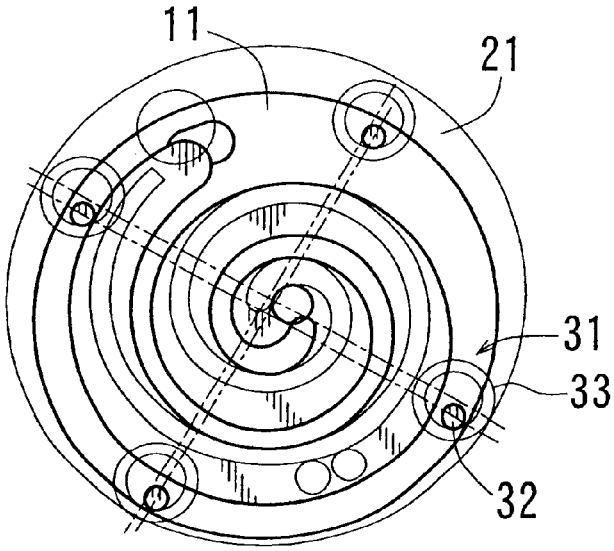
Figure 4:
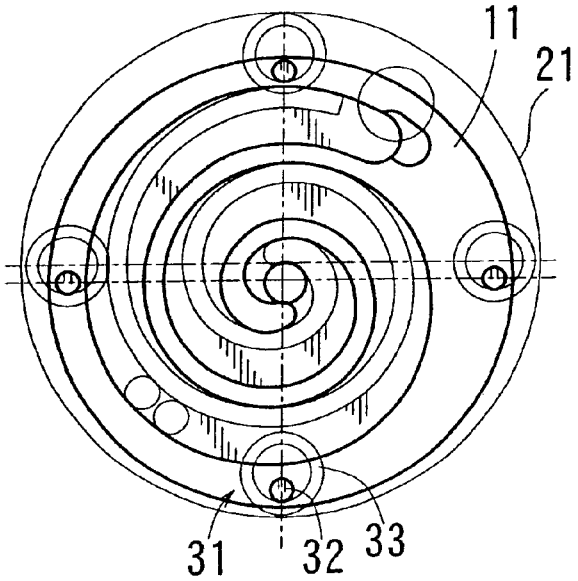
Figure 4:
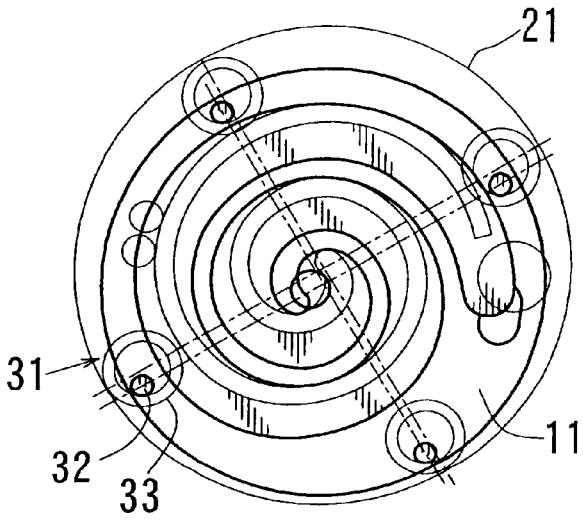
Figure 4:
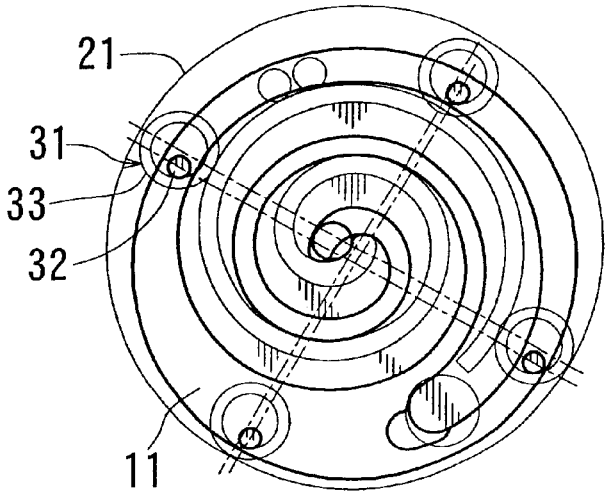

Still referring to FIG. 1, a transmission or transmission mechanism 31 may be disposed between the drive scroll 10 and the driven scroll 20. The transmission mechanism 31 may serve to transmit the rotation of the drive scroll 10 to the driven scroll 20, so that the driven scroll 20 will rotate in synchronism with the drive scroll 10. As shown in FIGS. 2 and 3, the transmission mechanism 31 may include a plurality of pins 32 and a plurality of rings 33 (e.g., four pins 32 and rings 33 are shown in FIG. 2). The pins 32 may be attached to the outer peripheral portion of the scroll wall 12 and may extend forwardly from the front surface of the scroll wall 12 along the axial direction of the drive scroll 10. The pins 32 may be spaced from each other around the circumference of the scroll wall 12 at suitable intervals. The rings 33 may be attached to the scroll plate 21 at positions corresponding to the pins 32. Therefore, the pins 32 may contact the inner circumferential surfaces of the respective rings 33. Preferably, the rings 33 may be fitted into respective circular recesses 21*a* that are defined within the scroll plate 21. If rings 33 are incorporated into the design, the outer diameter of the scroll plate 21 preferably may be greater than the outer diameter of the scroll wall 12 of the drive scroll 10.

Accordingly, as the drive scroll 10 rotates with the rotor 6, the pins 32 may slide along the inner circumferential surfaces of the respective rings 33. Therefore, the rings 33 will be urged to rotate about their central axes. As a result, the rotational torque of the drive scroll 10 can be transmitted to the driven scroll 20. As shown in FIG. 3, the distance between the central axis of the ring 33 and the central axis of the pin 32 during this transmission may be, e.g., equal to the distance "e" between the rotational axis of the drive scroll 10 and the rotational axis of the driven scroll 20.

FIGS. 4(A) to 4(F) serially depict views of the first representative embodiment as torque is transmitted via the pins 32 and the rings 33. These figures show each rotational angle of 60° during one full or complete rotation (i.e., 360°) of the drive scroll 10. As the drive scroll 10 rotates with the rotor 6, the pins 32 slidably contact the inner circumferential surfaces of the respective rings 33 in order to transmit rotational torque from the drive scroll 10 to the driven scroll 20. For example, each of the pins 32 may transmit rotational torque to the respective ring 33 only when the pin 32 is positioned within an angular range L, as indicated in FIG. 4(A). Although the driven scroll 20 rotates in synchronism with the drive scroll 10, the rotational axis of the driven scroll 20 is offset with respect to the rotational axis of the drive scroll 10. Therefore, the driven scroll 20 revolves (orbits) relative to the drive scroll 10.

As a result, refrigerant is drawn into the main housing 2 via an inlet port 3*a* defined in the front cover 3, as shown in FIG. 1. As shown in FIG. 2, the refrigerant is then drawn into the compression chamber 30 via suction ports 18*a,* 18*b* and 18*c,* which ports 18*a,*18*b* and 18*c* are defined within the base plate 21 of the driven scroll 20 and are located at an interval of an angle of 180° from each other. As the driven scroll 20 revolves (orbits) with respect to the drive scroll 10, each compression chamber 30 will move in a direction from the outer periphery to the center of the scroll walls 12 and 22 of the drive and driven scrolls 10 and 20. The volume of each compression chamber 30 will decrease as the compression chambers 30 move toward the inner circumferential ends of the scroll walls 12 and 22.

As described above, according to this representative embodiment, refrigerant may be drawn into the main housing 2. Therefore, the enclosed space defined by the main housing 2 and the front cover 3 may form a suction region. As a result, the pressure of the drawn refrigerant (e.g., relatively low pressure of the drawn refrigerant) may be applied to the surfaces of the drive scroll 10 and the driven scroll 20 that are exposed to the drawn refrigerant.

As shown in FIG. 1, a sub suction port 19 optionally may be defined within the base plate 11. In this case, the drawn refrigerant also may be drawn into the compression chambers 30 via the motor 4 and the bearing 14.

Still referring to FIG. 1, a discharge port 26 may be defined within the central portion of the base plate 21 and may communicate with the innermost compression chamber 30. A discharge chamber (i.e., discharge space) 27 may be defined as a cylindrical-shaped bore that is defined within the cylindrical boss portion 23 on the front side of the base plate 21. Thus, the discharge chamber 27 is formed in a portion of a front side region of the base plate 21 and is designed to receive the highly pressurized refrigerant that has been compressed within the compression chamber 30. As mentioned above, the highly pressurized refrigerant disposed within the discharge chamber 27 will apply a force against the driven scroll 20. The amount of force that is applied to the driven scroll 20 by the pressurized refrigerant can be adjusted by changing the surface area and/or the volume of the discharge chamber 27, as will be discussed further below.

The front cover 3 also may include a cylindrical portion 3*c* that is disposed within the cylindrical boss portion 23. Seal members 29*a* and 29*b* may be fitted onto the cylindrical boss portion 23 so as to provide seals at the mating face of the inner surface of the cylindrical boss portion 23 and at the mating face of the outer surface of the cylindrical boss portion 23 and the front cover 3 in order to prevent the refrigerant within the discharge chamber 27 from leaking into the relatively low-pressure region.

A discharge valve 28 may be disposed within the discharge chamber 27 and may serve to open and close the discharge port 26. For example, the discharge valve 28 may be a reed valve. However, other types of valves may be utilized as the discharge valve. The front cover 3 may cover or enclose the front side of the discharge chamber 27 and may include an outlet port 3*b* that communicates with the discharge chamber 27. A refrigerant discharge line to an external refrigerantion circuit (not shown) may be connected to the outlet port 3*b*.

According to the above-described representative scroll compressor, during the operation of the compressor, refrigerant (i.e., relatively low pressure refrigerant) is drawn into the main housing 2 and then flows into the compression chamber(s) 30 via a clearance or a flow path provided between the drive scroll 10 and the main housing 2 or the front cover 3. The refrigerant is then compressed within the compression chamber 30 and is thereafter discharged into the discharge chamber 27, which is formed on the front side of the driven scroll 20 (left side as viewed in FIG. 1), via the discharge port 26 and the discharge valve 28.

The pressurized refrigerant within the discharge chamber 27 will then apply a force against the front surface of the base plate 21 (i.e., the left surface as shown in FIG. 1), thereby biasing or urging the driven scroll 20 toward the compression chamber(s) 30 and the drive scroll 10. Thus, the discharged refrigerant will generate a thrust force that counters or opposes the thrust force that is applied to the driven scroll 20 by the pressured refrigerant disposed within the compression chamber 30. As noted above, the discharge chamber 27 is defined by the space that is enclosed by the cylindrical boss portion 23. Therefore, the amount of thrust force applied to the driven scroll 20 by the discharged (pressurized) refrigerant may be selectively determined by adjusting the volume of the discharge chamber 27 and/or the area of the front surface of the base plate 21 of the driven scroll 20 onto which the thrust force of the discharged refrigerant is applied.

Therefore, the discharge chamber 27 can be designed so that the driven scroll 20 may be pressed against the drive scroll 10 by an appropriate force. As a result, an appropriate seal may be ensured between the tip ends of the scroll walls 12 and 22 and the surfaces of the base plates 11 and 12 to which the tip ends of the scroll walls contact. Because the driven scroll 20 can move or slide in the axial direction in response to the respective forces that are applied to the front and rear side of the driven scroll 20, the tip ends of the scroll walls 11 and 12 may be prevented from being damaged during compressor operation.

Further, in the first representative embodiment, the refrigerant pressurized within the compression chambers 30 may be discharged to the side of the driven scroll 20 that is opposite to the compression chambers 30. The pressurized refrigerant is then discharged to the outside via the discharge port 3*b*. On the other hand, the refrigerant (i.e., low pressure refrigerant) that is returned from an external refrigeration circuit may be drawn in the main housing 2 via the inlet port 3*a*. Therefore, the portions within the main housing 2 that communicate the relatively low pressure refrigerant may define a relatively low-pressure region within the main housing 2. Because the relatively low pressure refrigerant will not apply much force against the portions of the main housing 2 that define the relatively low-pressure region, the main housing 2 may be constructed using a relatively thin wall, thereby reducing the total weight of the compressor 1. Furthermore, because the temperature of the drawn (i.e., relatively low pressure) refrigerant is lower than the temperature of the discharged (i.e., relatively high pressure) refrigerant, the motor 4 can be effectively cooled by the drawn refrigerant and the motor bearings (e.g., bearing 14) can be effectively lubricated by a lubricating oil circulated with the refrigerant.

Furthermore, as discussed above, a rotor of an electric motor drives the driven scroll of the known compressor via an Oldham's coupling. Therefore, in known compressors, it is necessary to twice adjust the respective positions of the drive scroll, the rotor of the electric motor and the driven scroll in order to obtain a precise positional relationship between the scroll walls of the drive and driven scrolls. However, according to the first representative embodiment of the present teachings, the relative rotational position between the drive scroll 10 and the driven scroll 20 can be determined in response to the precision in the configurations of the drive scroll 10 and the driven scroll 20 and the precision of the transmission mechanism 31 (e.g., the pin 32 and the ring 33). Therefore, the positional relationships of the various components can be more precisely defined by utilizing the present teachings.

Figure 5:
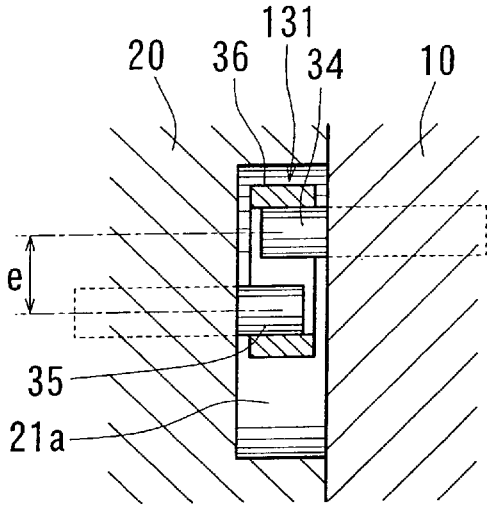
FIG. 5 is a cross-sectional view of a second representative transmission mechanism.
Figure 6:
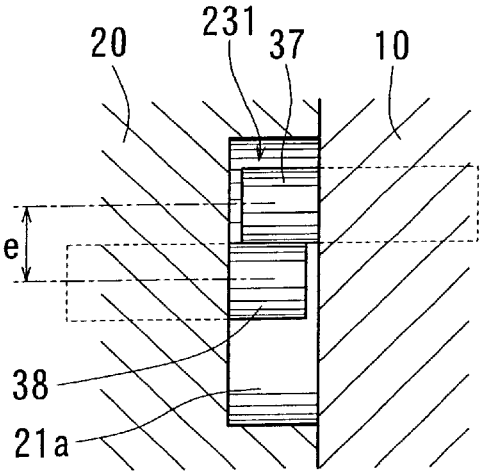
FIG. 6 is a cross-sectional view of a third representative transmission mechanism.
Figure 7:
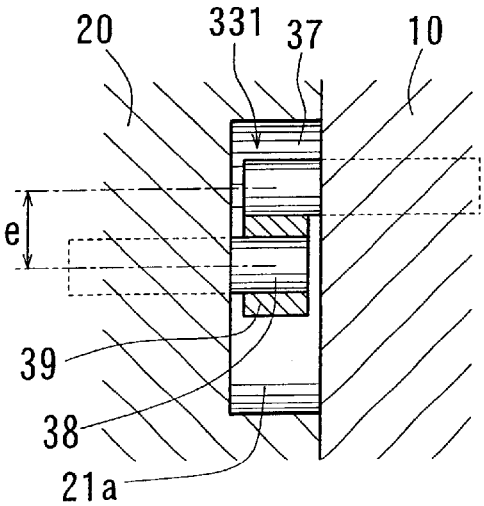
FIG. 7 is a cross-sectional view of a fourth representative transmission mechanism.

FIGS. 5 to 7 show additional modifications of the transmission mechanism 31, which causes the driven scroll 20 to rotate in synchronism with the drive scroll 10.

A transmission mechanism 131 of the embodiment shown in FIG. 5 may be configured as a pin-ring-pin system and may include cylindrical pins 34, 35 and a free ring 36. The pins 34 and 35 may be respectively mounted on the drive scroll 10 and the driven scroll 20. The pins 34, 35 and the free ring 36 may be arranged such that the pins 34 and 35 may slidably contact the inner circumferential surface of the free ring 36. Further, the central axes of the pins 34, 35 and the free ring 36 may be aligned along the same line. The free ring 36 may be disposed within a circumferential recess 21*a* formed in the driven scroll 20. Therefore, the free ring 36 can rotate about the pin 35 within the recess 21*a*.

A transmission mechanism 231 of the embodiment shown in FIG. 6 may be configured as a pin-pin system and may include pins 37 and 38. This arrangement may provide a simple transmission mechanism for synchronously driving the driven scroll 20 with the drive scroll 10. The pins 37 and 38 may be fixedly mounted or rotatably mounted on the drive scroll 10 and the driven scroll 20, respectively. According to this arrangement, the pin 37 rotates around the pin 38 and the pin 37 may slidably contact the pin 38. Thus, rotational torque can be transmitted from the drive scroll 10 to the driven scroll 20.

A transmission mechanism 331 of the embodiment shown in FIG. 7 is similar to the transmission mechanism 231 shown in FIG. 6. However, the transmission mechanism 331 differs from the transmission mechanism 231 in that a ring 39 is rotatably mounted on the pin 38. Therefore, the pin 37 slidably contacts the ring 39 around the pin 38. This arrangement may reduce friction during sliding contact between the pins 37 and 38 and may reduce the wear of the pins 37 and 38. Although not shown in the drawings, a ring also may be rotatably mounted on the pin 37.

Thus, each of the transmission mechanisms 31, 131, 231 and 331 may have a relatively simple construction while permitting the driven scroll 20 to smoothly rotate in synchronism with the drive scroll 10.

In one additional modification of the first representative embodiment, although the needle bearing 24 rotatably and axially movably supports the driven scroll 20, the needle bearing 24 may be replaced with a plain bearing. In such a case, the plain bearing also may serve to provide a seal that prevents the refrigerant within the discharge chamber 27 from flowing into the relatively low-pressure region defined within the housing 2.

Figure 8:
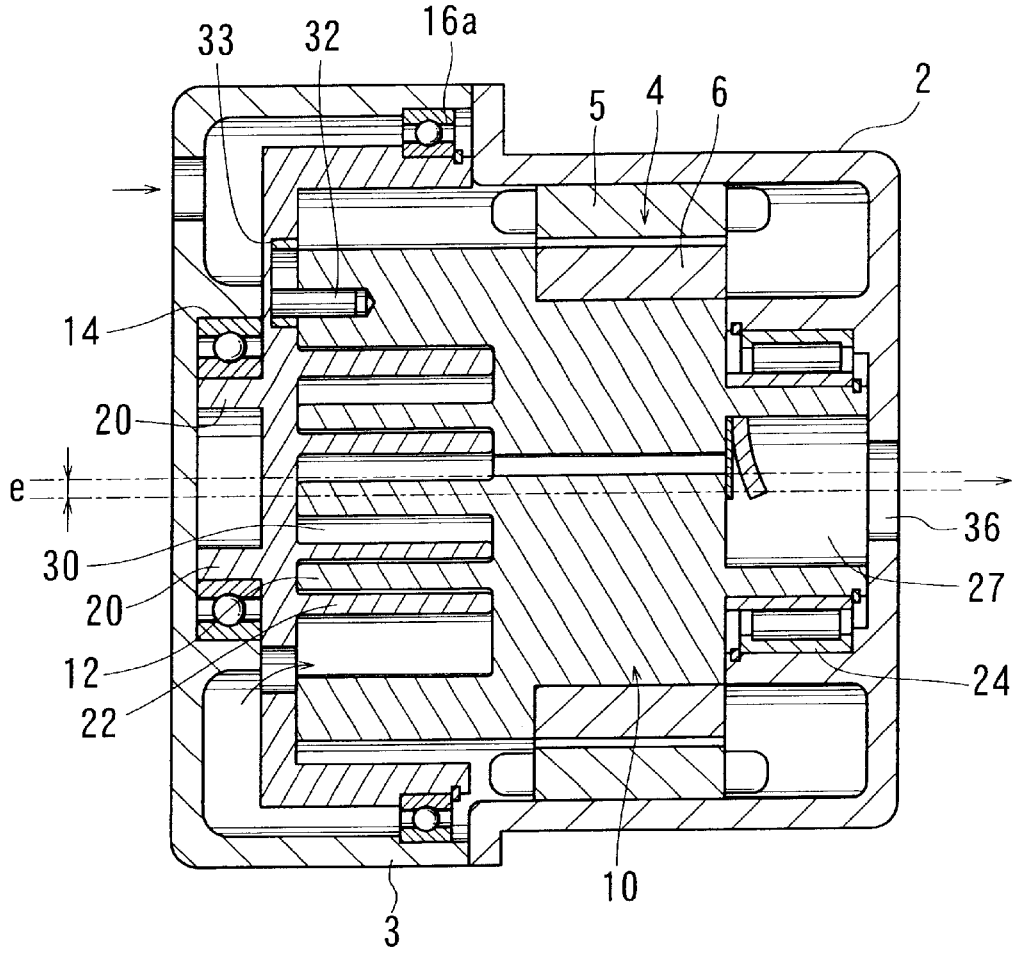
FIG. 8 is a vertical cross-sectional view of a second representative scroll compressor.

As discussed in detail above, in the first representative embodiment, the drive scroll 10 is supported in a straddle manner and the driven scroll 20 is supported in a cantilever manner. However, according to the present teachings, this arrangement may be reversed. For example, the drive scroll 10 may be supported in a cantilever manner and the driven scroll 20 may be supported in a straddle manner, as shown in FIG. 8. In such a case, the discharge chamber 27 may be formed on the rear side of the drive scroll 10 opposite to the compression chamber 30.

As shown in FIG. 8, the drive scroll 10 is rotatably supported by needle bearing 24 in a cantilever manner. Main housing 2 supports needle bearing 24. Further, needle bearing 24 permits the drive scroll 10 to move or slide along its axial direction. Ball bearings 14 and 16*a* rotatably support the driven scroll 20 in a straddle manner. Ball bearings 14 and 16*a* are supported by rear housing 3. Again, the rotor 6 of electric motor 4 may rotatably drive the drive scroll 10. The pressurized refrigerant disposed within discharge chamber 27 will apply a thrust force against the drive scroll in the direction towards the compression chamber(s) 30. This thrust force will counter or oppose the thrust force outwardly applied by the pressurized refrigerant still disposed within the compression chamber(s) 30. Thus, by appropriately selecting the size of the discharge chamber 27 (i.e., in order to selectively determine the amount of thrust force that the discharged refrigerant will apply against the drive scroll 10), the relative pressures inside and outside the compression chamber(s) 30 can be suitably selected. Preferably, the relative pressures are selected in a manner that prevents the tips ends of the scroll walls 12, 22 from being damaged during compressor operation.

What is claimed is:

1. A scroll compressor, comprising:

a drive mechanism, a drive scroll rotatably driven by the drive mechanism and having a first rotational axis, a driven scroll opposing the drive scroll and having a second rotational axis, wherein at least one compression chamber is defined between the drive scroll and driven scroll, the first rotational axis is parallel to, but offset from, the second rotational axis, and the driven scroll is arranged and constructed to be rotatably driven in synchronism with the drive scroll;

wherein a first scroll selected from the drive scroll and the driven scroll is supported in a straddle manner from sides that are opposite to the at least one compression chamber, and a second scroll selected from the other of the drive scroll and the driven scroll is supported in a cantilever manner from one side that is opposite to the at least one compression chamber, wherein the second scroll is arranged and constructed to be movable along its axial direction; and a discharge chamber defined within a face of the second scroll that is opposite to the at least one compression chamber, wherein the discharge chamber is arranged and constructed to receive relatively high pressure refrigerant discharged from the at least one compression chamber, and the second scroll is further arranged and constructed to be biased toward the first scroll when the relatively high pressure refrigerant applies a force against the second scroll.

2. A scroll compressor as in claim 1, wherein the drive mechanism comprises an electric motor, and further including housing defining a substantially sealed chamber that accommodates the drive scroll, the driven scroll and the electric motor, wherein a relatively low pressure suction pressure region is defined within the substantially sealed chamber.

3. A scroll compressor as in claim 1, further including a transmission arranged and constructed to synchronously transmit rotation of the drive scroll to the driven scroll, the transmission including a first torque transmission member disposed on the drive scroll and a second torque transmission member disposed on the driven scroll, whereby rotation of the drive scroll is transmitted to the driven scroll via the first and second torque transmission members.

4. A scroll compressor as in claim 3, wherein the first torque transmission member is arranged and constructed to rotate relative to and around the second torque transmission member, wherein the first and second rotational axes are offset with respect to each other and the radius of rotation of the first torque transmission member is equal to the offset distance between the first and second rotational axes.

5. A scroll compressor as in claim 4, wherein the drive mechanism comprises an electric motor, and further including housing defining a substantially sealed chamber that accommodates the drive scroll, the driven scroll and the electric motor, wherein a relatively low pressure suction pressure region is defined within the substantially sealed chamber.

6. A scroll compressor as in claim 4, wherein the first torque transmission member comprises a pin, and the second torque transmission member comprises a ring, wherein the pin is arranged and constructed to slidably rotate along an inner circumferential surface of the ring.

7. A scroll compressor as in claim 4, wherein the first torque transmission member and the second torque transmission member each respectively comprise a pin and the transmission further includes a free ring, wherein the pins are arranged and constructed to slidably rotate along an inner circumferential surface of the ring.

8. A scroll compressor as in claim 4, wherein the first and second torque transmission members respectively comprise a first pin and a second pin, wherein the first pin is arranged and constructed to slidably rotate around the second pin.

9. A scroll compressor as in claim 8, further comprising at least one ring rotatably mounted on one of the first pin or the second pin, wherein the first pin and/or the second pin can slidably rotate around an outer circumferential surface of the ring.

10. A scroll compressor as in claim 4, further including first means for rotatably supporting the first scroll in a straddle manner and second means for rotatably supporting the second scroll in a cantilever manner.

11. A scroll compressor as in claim 10, wherein at least one of the first means or second means comprises a bearing.

12. A scroll compressor as in claim 1, further including first means for rotatably supporting the first scroll in a straddle manner and second means for rotatably supporting the second scroll in a cantilever manner.

13. A scroll compressor as in claim 12, wherein at least one of the first means or second means comprises a bearing.

14. A method for compressing a refrigerant within a compressor having a drive scroll, a driven scroll and a discharge chamber defined within one of the drive scroll or driven scroll, comprising:

drawing refrigerant into at least one compression chamber defined between the drive scroll and driven scroll by rotating the drive scroll, wherein pressurized refrigerant is disposed within the at least one compression chamber, discharging pressurized refrigerant into the discharge chamber, wherein pressurized refrigerant is disposed within the discharge chamber and applying a thrust force against one of the drive scroll and the driven scroll, the thrust force being generated by the pressure of the refrigerant disposed within the discharge chamber.

15. A compressor comprising:

a drive scroll, a driven scroll, a discharge chamber defined within one of the drive scroll or driven scroll, means for drawing refrigerant into at least one compression chamber defined between the drive scroll and driven scroll by rotating the drive scroll, wherein pressurized refrigerant is disposed within the at least one compression chamber, means for discharging pressurized refrigerant into the discharge chamber, wherein pressurized refrigerant is disposed within the discharge chamber, means for applying a thrust force against one of the drive scroll and the driven scroll, the thrust force being generated by the pressure of the refrigerant within the discharge chamber.

16. A scroll compressor as in claim 15, further comprising an electric motor rotatably driving the drive scroll and a housing defining a substantially sealed chamber that accommodates the drive scroll, the driven scroll and the electric motor, wherein a relatively low pressure suction pressure region is defined within the substantially sealed chamber.

17. A scroll compressor as in claim 16, further including a transmission arranged and constructed to synchronously transmit rotation of the drive scroll to the driven scroll, the transmission including a first torque transmission member disposed on the drive scroll and a second torque transmission member disposed on the driven scroll, wherein rotation of the drive scroll is transmitted to the driven scroll via the first and second transmission members.

18. A scroll compressor as in claim 17, further including means for rotatably supporting one of the drive scroll and the driven scroll in a straddle manner and means for rotatably supporting the other of the drive scroll and the driven scroll in a cantilever manner.

19. A scroll compressor as in claim 15, further including means for rotatably supporting one of the drive scroll and the driven scroll in a straddle manner and means for rotatably supporting the other of the drive scroll and the driven scroll in a cantilever manner.

* * * * *